United States Patent [19]

Mejia

[11] 4,061,441

[45] Dec. 6, 1977

[54] CENTRIFUGAL FAN FOR CIRCULATING ROOM AIR

[76] Inventor: Reynaldo Mejia, 122 S. Sixth St., Fowler, Calif. 93625

[21] Appl. No.: 678,883

[22] Filed: Apr. 21, 1976

[51] Int. Cl.[2] ..... F04D 29/28

[52] U.S. Cl. ..... 416/175; 416/178

[58] Field of Search ..... 416/175, 197, 179, 181, 416/178, 187

[56] References Cited

U.S. PATENT DOCUMENTS

| | | | |
|---|---|---|---|
| 939,136 | 11/1909 | Jacobsen | 416/187 X |
| 1,174,938 | 3/1916 | Montgomery | 416/175 X |
| 1,321,378 | 11/1919 | Kohn | 416/188 |
| 1,471,141 | 10/1923 | Capell | 416/175 |
| 1,784,072 | 12/1930 | Oliver | 416/175 X |
| 2,011,298 | 8/1935 | Osbun et al. | 416/175 X |
| 2,104,233 | 1/1938 | Leinweber | 416/175 |
| 2,269,049 | 1/1942 | Zellweger | 416/175 |
| 2,962,207 | 11/1960 | Mayne | 416/187 |
| 3,201,032 | 8/1965 | Gelbardd | 416/187 X |
| 3,368,744 | 2/1968 | Jenn | 416/187 X |

FOREIGN PATENT DOCUMENTS

| | | | |
|---|---|---|---|
| 1,301,306 | 7/1962 | France | 416/187 |

*Primary Examiner*—Everette A. Powell, Jr.
*Attorney, Agent, or Firm*—Huebner & Worrel

[57] ABSTRACT

A centrifugal fan for circulating room air characterized by an impeller supported for unidirectional rotation about a vertical axis. The fan includes a circular array of vertically oriented, radially extended blades, each blade being at its ends to a pair of end plates and characterized by a leading surface of a substantially flute-like configuration defining a forwardly opening compression chamber extended along the length thereof and communicating with apertures extended radially into the end plates, between the ends of adjacent blades defining openings for accommodating vertical streams of air flowing between the blades.

1 Claim, 5 Drawing Figures

CENTRIFUGAL FAN FOR CIRCULATING ROOM AIR

BACKGROUND OF THE INVENTION

1. Field of the Invention

The invention generally relates to cooling devices, and more particularly to a centrifugal fan having an improved impeller particularly suited for use in establishing currents of room air for enhancing occupant comfort.

2. Description of the Prior Art

The prior art, of course, is replete with pneumatic devices which serve to establish currents of air for various purposes. Among such devices are those employed for purposes of enhancing the comfort of occupants of an enclosure, such as the room of a dwelling or similar enclosure. These devices frequently are referred to as fans and include impellers which serve to establish cooling currents of air as rotation is imparted thereto. In some instances a fan is designed to operate in close proximity with a floor in order to cause streams of air found in cooler zones, just above the level of the floor, to move upwardly into the air of warmer zones for cooling purposes. A fan of this type which has experienced generally widespread acceptance often is referred to as a Hassick fan. Such a fan frequently is adapted to be seated on the floor and is provided with impeller blades which serve to impart vertical momentum to a body of air, whereby an upwardly directed air current is established as rotary motion is imparted to the blades. Of course, as can be appreciated by those who are familiar with such fans, the efficiency often is less than desired, simply because the currents thus established lack sufficient horizontal momentum and velocity to perform a suitable cooling function.

Another type of fan sometimes employed for purposes of circulating air within a room includes an impeller having blades supported for rotation about a horizontally extended axis for purposes of establishing a horizontally directed stream of air. Such fans, also, have acquired general acceptance. However, as can be appreciated by those familiar with these devices, the air streams established through an operation thereof tend to be highly directional. Unfortunately, such devices are, in many instances, found to be impractical due to their innate directional characteristics and the attendant turbulence created through an operation thereof.

Centrifugal fans also are well known. These fans are characterized by impellers having arrays of elongated blades supported in substantial parallelism. Frequently, the impellers of centrifugal fans are employed in the substantially closed housing for accelerating streams of air through a conduit, while the conduit and housing serve to convert the velocity of the air to pressure. Such impellers, generally, are not employed without a housing and tend to lack a capability for establishing suitable air currents in open spaces such as are needed in the cooling of rooms of a dwelling.

Since fans adapted to circulate room air for cooling occupants generally have experienced widespread acceptance, and the use thereof is highly desirable, particularly in those instances where refrigerated air is not available, attempts to increase the overall efficiency of such devices is sought continuously.

It is therefore a general purpose of the instant invention to provide a fan having an improved impeller having an enhanced capability for circulating room air with greater efficiency.

OBJECTS AND SUMMARY OF THE INVENTION

It is an object of the instant invention to provide an improved fan for circulating room air.

Another object is to provide a fan having an improved impeller for circulating room air with increased efficiency. Another object is to provide an improved fan for circulating room air, including an improved impeller supported for unidirectional rotation about a vertical axis for establishing omnidirectional currents of air.

Another object is to provide in a fan for circulating room air an improved impeller supported for unidirectional rotation about a vertical axis, including a cylindrical array of vertically oriented, mutually spaced, radially extended blades configured to provide elongated, vertically oriented compression chambers communicating with radially extended apertures, which serve to direct streams of air vertically along said chambers.

Another object is to provide an improved fan for circulating air within enclosures such as the rooms of dwellings, although not necessarily restrictive in use thereto since the fan may be similarly useful when installed in other enclosures such as offices, factories and the like which require maximum cooling for occupant comfort.

These together with other objects and advantages are achieved through the use of a fan having an impeller supported for unidirectional rotation about a vertical axis and characterized by a cylindrical array of vertically oriented, mutually spaced, radially extended blades, each blade of the plurality being provided with a leading surface of a flute-like configuration defining a forwardly opening compression chamber having a longitudinal axis of symmetry paralleling the vertical axis about which the impeller is rotated, end plates having radially extended apertures and vertically oriented deflectors for directing streams of air axially along the chambers as will become more readily apparent by reference to the following description and claims in light of the accompanying drawings.

DESCRIPTION OF THE PREFERRED EMBODIMENT

Figure 1:
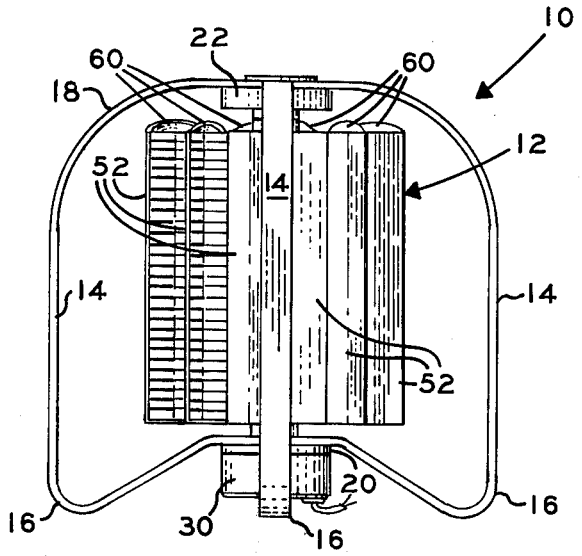
FIG. 1 is a side elevational view of an improved fan which embodies the principles of the instant invention.
Figure 2:
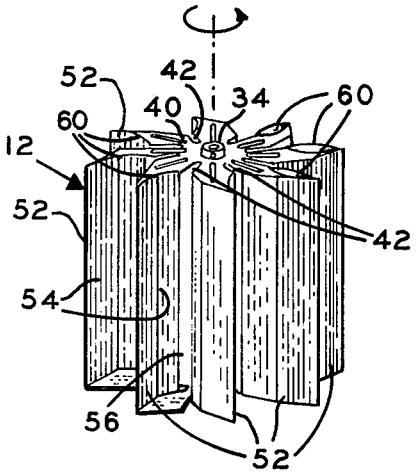
FIG. 2 is a perspective view of an impeller included within the device shown in FIG. 1.

Referring now with more particularity to the drawings wherein like reference characters designate like or corresponding parts throughout the several views, there is shown in FIG. 1 an improved fan, generally designated 10, which embodies the principles of the instant invention.

As shown in FIG. 1, the fan 10 includes an impeller, generally designated 12, of a drum-like configuration. The impeller 12 is supported within a cage, not designated, formed of a plurality of deformed bars 14. Each of the bars is suitably deformed to establish a base portion 16 which collectively form a pedestal for the fan. Each of the bars is further deformed to establish a crown portion 18, which collectively form a cover for the fan. While the particular material from which the bars 14 are formed, as well as the specific number of bars employed, is a matter of convenience and is varied as desired, the fan 10, as shown, includes four bars fabricated from spring steel and arranged in orthogonally related planes.

The bars 14 are secured at their lowermost ends to a disk-shaped base plate 20. The upper ends of the bars similarly are secured to a cap plate 22, also of a disk-shaped configuration. The bars 14 are secured to the plates 20 and 22 by suitable means, not designated, including rivets, welds, screw-and-nut fasteners and the like.

Extending between the plates 20 and 22 there is a vertically oriented drive shaft 24. The drive shaft 24 is supported at its ends by journal bearings 26 and 28 which are, in turn, suitably mounted on the plates 20 and 22, respectively. It will, therefore, be appreciated that the drive shaft 24 is supported for rotation by the bearings 26 and 28.

Rotation is imparted to the drive shaft 24 through an electrically energizable motor, designated 30. The motor 30 is attached to the lowermost end of the drive shaft 24, in a suitable manner and suspended from the plate 20. The motor 30 preferably is of a design capable of imparting unidirectional rotation to the drive shaft 24 in response to a closing of an electrical switch, not shown. The rate of angular displacement at which the shaft 24 is driven is, also, varied as desired.

Arranged in concentric relation with the drive shaft 24, in close proximity with the bearings 26 and 28, there is a pair of annular collars, designated 32 and 34, respectively. These collars are affixed to the drive shaft 24 employing suitable fasteners such as set-screws and the like, not designated. The collar 32 serves as a mount for a bottom end plate 36, provided for the impeller 12, while the collar 34 serves to mount a top end plate 38. The plates 36 and 38 are commonly configured and dimensioned and are arranged in vertically spaced relation.

As a practical matter, the plates 36 and 38 are of a substantially star-shaped configuration and include a plurality of commonly configured and radially extended arms 40. The arms 40 are mutually spaced to provide therebetween radially extended apertures 42 which function as air inlet passages, the purposes of which will hereinafter become more readily apparent.

The arms 40, for each of the plates 36 and 38, project radially from a common base 44 and terminate in distal end portions, designated 46. The distal end portions of the arms 40 are of a substantially triangular configuration, established through a rearward inclination of the leading edges, designated 48, of the distal end portions of the arm 40, and a forward inclination of the trailing edges, designated 50, of the arms.

The arms 40 for the plates 36 and 38 are arranged in vertical alignment pairs. Between the trailing edges of each pair of arms 40 there is extended an impeller blade 52. The impeller blades 52 are affixed to the trailing edges 50 of the arms 40 in any suitable manner, such as by welding, riveting and the like. The blades 52 are extended in substantial parallelism with the drive shaft 24, whereby the blades collectively establish a cylindrical array.

It is important here to note that each of the impeller blades 52 is of a flute-shaped configuration and includes at its leading surface an elongated, vertically oriented compression chamber 54. As a practical matter, each of the impeller blades 52 is of a uniform thickness and of a V-shaped cross-sectional configuration. It is important also to note that between the innermost edge of each of the impeller blades 52 and the drive shaft 24 there is defined a void 56. These voids collectively define a cylindrical plenum chamber, designated 58, located radially inwardly of the impeller blades. The apertures 42, aforementioned, communicate with the chamber 54 and the chamber 58 and serve as intake ports which accommodate a passage of vertically oriented streams of air drawn into the impeller 12 established as rotation is imparted thereto.

Immediately above each of the impeller blades 52, in substantial alignment with each of the chambers 54, there is provided an upstanding deflector 60 having a curved surface communicating with an adjacent compression chamber 54. The deflector 60 preferably is of a compound curved configuration formed by stamping or the like, and functions as an air intake scoop for purposes of forcibly directing a stream of air downwardly through the apertures 42 and axially along the chamber 54.

Hence, it will be appreciated that the compression chambers 54 not only are pressurized through impact with a body of air, but are further pressurized as a consequence of a stream of air being continuously directed downward from the aligned deflector 60 as rotary motion is imparted to the impeller. Of course, streams of air thus established are expelled radially, generally, as a consequence of spillage. Thus air currents having both radial and vertical components of momentum are established. Moreover, the plenum chamber 58 is pressurized as a consequence of air admitted through the apertures 42 for replacing air expelled from the chamber radially in response to radial momentum being imparted thereto as a consequence of rotation being imparted to the impeller.

OPERATION

It is believed that in view of the foregoing description, the operation of the device will readily be understood and it will be briefly reviewed at this point.

With the fan 10 assembled in the manner hereinbefore described, and with the motor 30 connected with a suitable source of electrical potential, through a switch not shown, rotary motion responsively is imparted to the drive shaft 24.

As rotary motion is imparted to the impeller 12, the impeller blades 52 serve to cut through the air. Air is thus caused to be entrapped within the chambers 54. Simultaneously, the deflectors 60 serve to scoop and direct continuous streams of air axially along the compression chambers 54. Due to the angular motion imparted to the impeller, these streams established tend to develop a vertical vortex above the fan 10. Of course, a zone of high pressure is established immediately before each of the leading surfaces of the impeller blades 52 in a manner well understood. Air thus entrapped is caused to spill radially from the fan under the influence of centrifugal forces.

Figure 4:
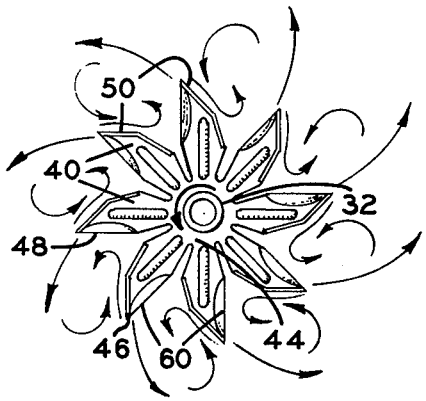
FIG. 4 is a top plan view of the impeller, diagrammatically illustrating vortexing air currents established by the impeller.
Figure 3:
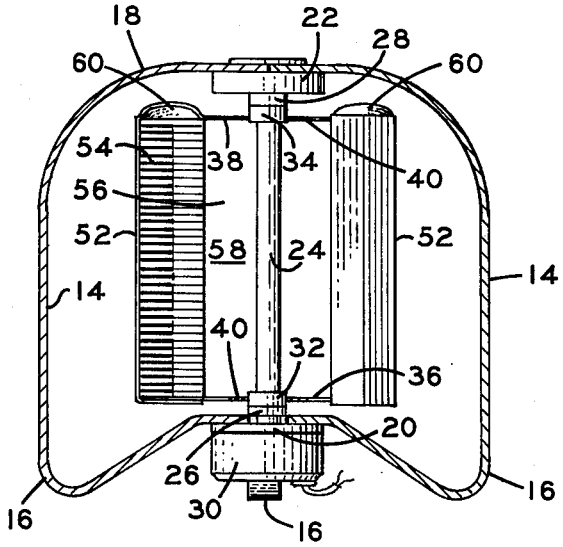
FIG. 3 is a vertically sectioned view of the device shown in FIG. 1.
Figure 5:
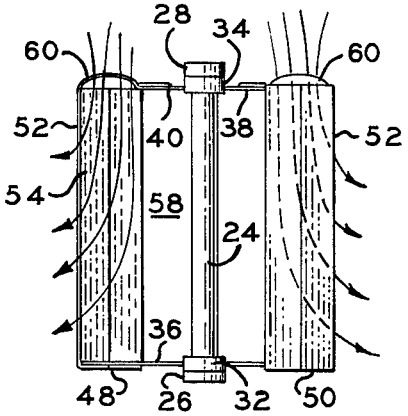
FIG. 5 is a vertically sectioned view of the impeller also diagrammatically illustrating air currents established by the impeller.

The rotary motion imparted to the impeller 12 also causes a low pressure zone to develop immediately behind each of the impeller blades 52. These low pressure zones, in turn, are filled by air rushing thereinto from the plenum chamber 58, by air passing in vertical directions through the apertures 42 and by air rushing thereinto from the periphery of the array of blades. As illustrated in FIG. 4, rotary motion of the impeller serves to impart radial momentum to air discharged as spillage from the fans occurs for thereby creating a series of vortexes moving radially at velocities determined by the rate of rotation of the impeller. Hence, air currents characterized by both radial and axial components of momentum are established and these currents possess sufficient momentum and velocities to expand outward and substantially traverse a given room with a vortexing motion.

In view of the foregoing, it should readily be apparent that the fan 10 of the instant invention provides a practical solution to the problem of increasing the efficiency of fans employed for circulating room air for cooling purposes.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A fan for circulating room air comprising:

an impeller supported for unidirectional rotation about a vertically oriented axis including:

A. a vertically oriented impeller shaft supported for driven rotation;

B. a pair of spaced, horizontally oriented end plates mounted in vertical registration on said shaft for unidirectional rotation, each end plate of said pair comprising:

a center section having defined therein a uniform array of radially extended slots for accommodating passage of air vertically through the plate, a uniform array of arms, each arm being integrally related to the center section and radially extended from between a pair of adjacent slots, each arm of said array being characterized by a distal end having a trailing edge surface, relative to the direction of plate rotation, including contiguous linear segments defining therebetween an included angle greater than 90° but less than 180°;

C. a cylindrical array of vertically oriented impeller blades extended between the distal end portions of said arms and defining a pressure chamber concentrically related to the array of blades and communicating with the array of slots, each blade being characterized by planar panel segments defining along the leading surface thereof a compression chamber of a V-shaped cross-sectional configuration, the planes of the panel segments being coincident with vertical planes extended between the registered contiguous surfaces of the arms of the pair of end plates, each compression chamber being closed at the lowermost end thereof by a planar surface of the distal end of one arm of the lower plate;

D. a deflector of a compound curved configuration projected upwardly from the distal end of each arm of the upper plate defining an air scoop communicating with a juxtaposed compression chamber defined along the leading surface of one of said blades for forcing air downwardly into the compression chamber;

E. means including a plurality of angularly spaced bars defining a base for supporting said impeller in a vertical orientation; and F. means including an electrically energizable motor connected with said shaft for imparting unidirectional rotary motion to said impeller.

* * * * *

UNITED STATES PATENT AND TRADEMARK OFFICE

CERTIFICATE OF CORRECTION

PATENT NO. : 4,061,441

DATED : December 6, 1977

INVENTOR(S) : Reynaldo Mejia

It is certified that error appears in the above-identified patent and that said Letters Patent are hereby corrected as shown below:

Column 2, line 10, after "efficiency." begin new paragraph.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*